United States Patent [19]

Parrott

[11] Patent Number: 4,846,631

[45] Date of Patent: Jul. 11, 1989

[54] GEARBOX FOR A ROTARY, MINERAL CUTTING HEAD

[75] Inventor: George A. Parrott, Wakefield, England

[73] Assignee: Minnovation Limited, Wakefield, England

[21] Appl. No.: 93,134

[22] Filed: Sep. 3, 1987

Related U.S. Application Data

[63] Continuation-in-part of Ser. No. 799,619, Nov. 19, 1986, abandoned.

[51] Int. Cl.[4] ..... F04B 1/10; E21C 25/60

[52] U.S. Cl. ..... 417/273; 91/492; 299/17; 417/463

[58] Field of Search ..... 299/17, 81; 417/273, 417/462, 463; 92/58; 91/491, 492

[56] References Cited

U.S. PATENT DOCUMENTS

| | | | |
|---|---|---|---|
| 1,910,581 | 5/1933 | Vickers | 417/273 |
| 2,461,121 | 2/1949 | Markham | 417/273 |
| 3,204,561 | 9/1965 | Roosa | 417/462 |
| 4,049,318 | 9/1977 | Fruin | 299/81 |
| 4,212,497 | 7/1980 | Borowski | 299/81 X |
| 4,331,064 | 5/1982 | Cheylus | 92/58 |

FOREIGN PATENT DOCUMENTS

| | | | |
|---|---|---|---|
| 287978 | 8/1931 | Italy | 91/204 |

OTHER PUBLICATIONS

"High Pressure Water Jet Assisted Cutting System for Shearer Loaders", *Mining Magazine,* Sep. 1987.

*Primary Examiner*—Leonard E. Smith
*Attorney, Agent, or Firm*—R. A. Giangiorgi

[57] ABSTRACT

A gearbox for a rotary, mineral cutting head, comprises a casing housing speed reduction gearing and also a portion of a drive shaft supported by first and second, spaced-apart bearings, with at least one radially extending cylinder having a closed inner end and an open, outer end provided in said drive shaft and a reciprocable piston partially housed in said cylinder with a fluid seal between said piston and said cylinder; a variable volume, pressure-generating chamber defined between a radially inner end of said piston and a closed, inner end of its cylinder; a ring surrounding said drive shaft and having an inner profile and with a radially outer end of said piston in contact with said inner profile and with said piston.

11 Claims, 4 Drawing Sheets

GEARBOX FOR A ROTARY, MINERAL CUTTING HEAD

This application is a continuation-in-part of application Ser. No. 799,619, filed Nov. 19, 1986, now abandoned.

This invention relates to a gearbox of a rotary mineral cutting head.

Various proposals exist for the discharge of water from a rotary, mineral cutting head. Such discharge may, at lower pressures, be for purposes such as dust suppression, and at higher pressures, be for water-jet cutting, or water-jet assisted cutting. With regard to the prior art, reference may be made to U.S. Pat. Nos. 3,799,615 (Taylor), 4,049,318 (Fruin) and 4,212,497 (Borowski). Examples of other prior art and in particular phasing arrangements to ensure that water is used efficiently i.e., by being discharged only from nozzles in the cut are disclosed in SU No. 581698 GB No. 2089869, GB No. 1144340, GB No. 1207817, GB No. 1110763 and GB No. 2015625.

Taylor teaches water pressure intensification within a rotary cutting head (in contrast to intensification at a remotely located pump with the high pressure water piped to the head) and the phased emission of high pressure water. Fruin teaches water pressure intensification by means of a multi-cylinder, radial pump also located in the rotary cutting head, with a phased water emission over the sector of the head within the cut. By being located in the head, such pump would require regular replacement, as the typical service life of such a head is conventionally no more than a few months, while furthermore the Fruin bearing ring is exposed to contamination by debris, rock, coal dust etc., and furthermore is not lubricated. Borowski follows what may be regarded as conventional practice in having the cutting head and pump as separate units whereby servicing, replacement or failure of one unit does not affect the other and teaches in fact no more than a phasing arrangement, to ensure that water is, only supplied to, and discharged from, nozzles in the cut, with high pressure water supplied by a high pressure pump located at a remote distance from discharge nozzles on the head, with the high pressure water fed invariably by lengthy, expensive, armoured pipework (for protection of personnel in the vicinity should pipe or pipe joint failure occur), and with inevitable pressure losses between the pump and the discharge nozzles.

According to the present invention there is provided a gearbox for a mineral cutting head comprising (i) a casing;

(ii) speed reduction gearing contained in said casing;

(iii) at least a portion of a drive shaft also contained in said casing said drive shaft having an axis of rotation, (iv) first and second bearings spaced apart along said axis;

(v) at least one radially extending cylinder having a closed inner end and an open, outer end being provided in said drive shaft;

(vi) a reciprocable piston at least partially housed in said cylinder(s) a fluid seal between the external periphery of said piston and said cylinder;

(vii) a variable volume, pressure-generating chamber defined between a radially inner end of said piston and a closed, inner end of its cylinder;

(viii) a ring surrounding said drive shaft an inner profile provided on said ring, (ix) a radially outer end(s) of said piston(s) being in contact at least in a pumping mode with said inner profile and with said piston(s), such that upon rotation of said drive shaft, variations in radial distance of said inner profile from said drive shaft axis of rotation causes reciprocation of said piston(s), and a consequent pumping effect, at least on fluid transfer port communicating with said pressure-generating chamber(s) with said first and second bearings also absorbing loading from said piston(s) and said ring); and (x) valve means to control fluid admission to, and delivery from, each of said pressure-generating chambers.

Thus, the invention provides an integrated and compact gearbox and hydraulic pump and by pre-charging the pressure chambers with fluid e.g. water, at relatively low pressure e.g. 100 to 200 psi, rotation of the drive shaft by a power source (e.g. an electric motor, with or without an interposed transmission which may if required effect speed reduction), displaces the or each piston radially inwardly to reduce the volume of its pressure chamber, thereby increasing the pressure of fluid in that chamber to the desired level e.g. determined by a flow restrictor or orifice, which may be 2,000 to 30,000 psi or even higher, but most significantly provides a water pressure intensifying pumping means inside the gearbox, giving the first and second bearings a third function i.e., absorbing loadings from the pumping means, (the first function being absorbing the drive torque applied to the drive shaft, and the second function being absorbing the cutting forces applied by the mineral to the head, these two functions being known e.g., from Borowski), and giving the drive shaft the second function of housing the reciprocable pistons, (beyond its primary function of driving the rotary cutting head, when the latter has been mounted on the gearbox). It will be appreciated that the low pressure charging, apart from requiring only low pressure seals in various ancillary components, maintains the outer ends of the piston(s) in permanent contact with the inner profile of the ring.

Conveniently, the gearbox is of the epicyclic kind, comprising a sun gear rotatable about the drive shaft axis and in drivable engagement with a plurality of planet gears carried by a portion of the drive shaft serving as a carrier, with the planet gears rotatable about axes parallel to the sun gear axis and in mesh with a stationary annulus.

In a first embodiment, the inner profile of the ring may be circular, with the ring located eccentrically with respect to the axis of rotation of the drive shaft, so that one revolution of the carrier produces one delivery stroke of the or each piston. Preferably, the ring is in the form of a bearing ring, with the inner profile provided by an inner, annular face of an inner race part, or a liner of that part, of the bearing ring, the inner race part being separated from an outer race part by a plurality of rollers, preferably double rollers, and the outer race part being located stationarily with respect to the carrier.

Thus, from a bottom dead centre (b.d.c) position where the volume of the or each pressure-generating chamber is at a minimum, rotation of the drive shaft commences what is in fact an induction stroke, with the eccentricity of the bearing ring being arranged to allow the piston(s) to slide radially outwards from its cylinder under the effect the pressure of the pre-charging fluid. Conveniently, the pressure chamber is at its maximum volume at a top dead centre (t.d.c) position, at which point the pressure chamber has been fully charged, and beyond which point diminution of the volume of the pressure chamber commences, due to the eccentricity of the bearing ring, until the b.d.c. position is reached, when the fluid in the pressure chamber has been discharged.

In a second embodiment, the ring is located concentrically with respect to the axis of rotation of the drive shaft, with the inner profile of the ring being lobed, to constitute a cam track and again being located stationarily with respect to the drive shaft, this arrangement producing multiple delivery strokes of the or each piston per revolution of the drive shaft. To reduce or eliminate friction between the or each piston and the lobed ring, the outer end of the or each piston is preferably provided with a roller follower arrangement.

With either the first or second embodiment, it is preferred to provide a plurality of cylinders and pistons e.g. two located 180° apart, three located 120° apart, four located 90° apart etc. Furthermore, increased output capacity from the or each piston can be achieved by providing banks of pistons, axially spaced from one another e.g. an eight piston pump may have a first bank of four pistons radially spaced 90° apart, which first bank is axially spaced from a second bank of four similar pistons. Conveniently, the drive shaft is mounted in bearings supported in a gearbox casing, which, in respect of the first embodiment, also locates the outer race of the bearing ring, and in respect of the second embodiment also locates the lobed rings.

Conveniently, the or each fluid transfer port serves for both the conveying of low pressure fluid to its associated pressure chamber, and the delivery of high pressure fluid from its associated pressure chamber, the valve means effecting suitable control. The or each fluid transfer port conveniently extends axially along the drive shaft and then terminates at a radial connection port in communication with its associated pressure-generating chamber. With regard to the valve means, it is preferred to employ one valve per piston, preferably a check valve. In one preferred arrangement, the check valve is located at an end of its fluid transfer port remote from its pressure chamber, and with this arrangement a pressure delivery port, preferably extending radially from its fluid transfer port intersects the latter in the vicinity of the check valve. Supply of low pressure fluid may be effected by a delivery port, connected to a source of supply of low pressure fluid, and in communication with the check valve. In another embodiment of valve means, the valve member is spring loaded into a seating position and has a frusto-conical nose, to engage a corresponding valve seat, provided with a sealing ring. In another embodiment of valve means, it is arranged for the low pressure or precharged fluid to open the associated check valve automatically at the radially innermost position of the or each piston, simultaneously closing a high pressure outlet or delivery port, the check valve closing, when the pressure cycle begins i.e. when radially outward movement of the or each piston commences, and the outlet or delivery port simultaneously being opened. Preferably, each check valve takes the form of a valve member slidable within a valve body. Conveniently, the valve member incorporates a smaller diameter face, adapted to be in communication with the lower, pre-charge pressure, and a larger diameter face adapted to be in communication with the higher, delivery pressure. In detail, the valve member may comprise a central bore, for transmission of low pressure fluid from a supply source to its pressure chamber. At the radially innermost position, pressure at the charge pressure on the smaller face displaces the valve member to allow flow of fluid at pre-charge pressure, and simultaneously to close an associated delivery port, with the valve member automatically being displaced, commencing at the radially outermost position, when pressure build up occurs in the pressure chamber above the pre-delivery pressure, such displacement closing off the inlet port and eventually exposing a delivery conduit for delivery of higher pressure fluid from the pressure chamber to the required delivery point.

Preferably, conventional oil seals are provided at the outsides of the first and second bearings between rotary and non-rotary parts of the gearbox, with fluid seals between the external periphery of the or each of the pistons and the cylinder in which the pistons is/are reciprocable, to maintain separation between the fluid (e.g., water) within said pressure generating chamber, and the oil of the gearbox.

According to a further aspect of the present invention, there is provided a gearbox in accordance with the invention as defined above, in combination with a rotary, mineral cutting head, with the first and second bearings additionally serving to absorb loading imposed upon said cutting head during cutting.

The cutting head may be of a kind intended for mineral winning purposes e.g. for mounting on the ranging arm of a shearer type mining machine, or alternatively may be of a kind intended for rock cutting purposes e.g. for mounting on a boom or other moveable element of a roadheader type machine for driving underground roadways, headings or tunnels. Thus, the cutting head may be provided with a plurality of replaceable cutter picks and furthermore, in the case of mineral winning, the head may be provided with one or more spiral vanes, on which at least some of the picks are mounted, for enhanced mineral loading onto an associated conveyor.

For a shearer type mining machine, the hollow drive shaft passing co-axially through both the gear box and cutting head would be provided, with at least one nozzle intended in use to direct a water spray along the hollow shaft to induce an air flow, and with two concentric tubes extending axially along the hollow shaft to convey water, at two different pressures to the rotary cutting head, a first pressure being for low pressure supply to the piston(s) of the carrier and the second pressure being a higher pressure supply to be conveyed to spray nozzles in the vicinity of the cutter picks. With this embodiment, the pressure delivery port of the or each pressure chamber serves to introduce the pressure fluid to a conduit system for conveyance to the vicinity of the cutter picks, for water jet assisted cutting of the mineral involved. In detail, the conduit system may incorporate an adaptor into which is fitted one end of a lance of length to convey the high pressure water supply to the vicinity of the cutter picks and in particular to a spray nozzle at the terminal end of the lance as described in European Patent Application No. 85303117.7. For safety purposes, a pressure relief bore may be in communication with the adaptor, the relief bore terminating in a burstable disc.

The invention, will now be further described in greater detail, by way of example, with reference to the accompanying drawings, in which.

Figure 1:
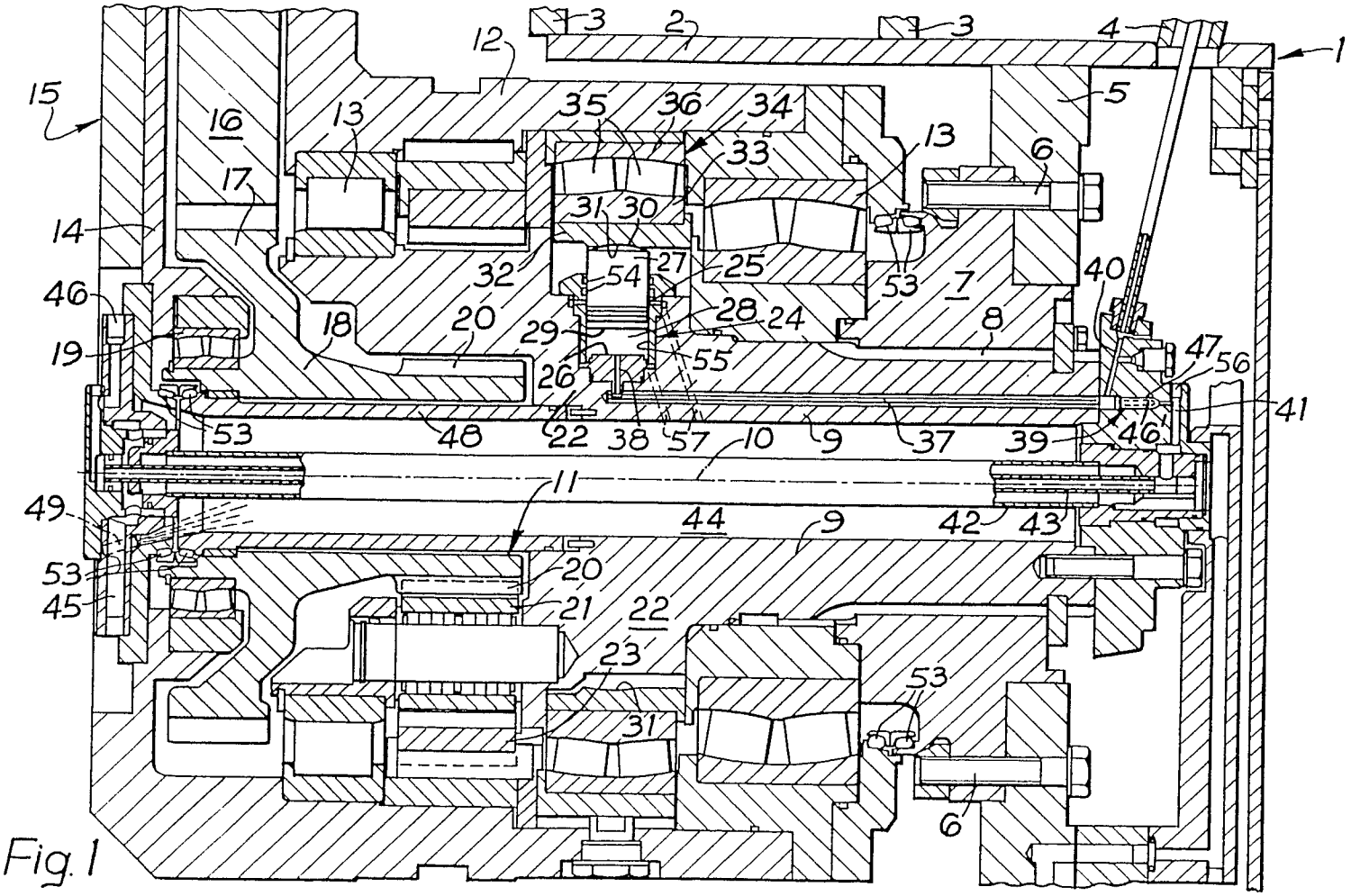
FIG. 1 is an axial sectional view through a first embodiment of gearbox and attached rotary mineral cutting head in accordance with the invention.
Figure 3:
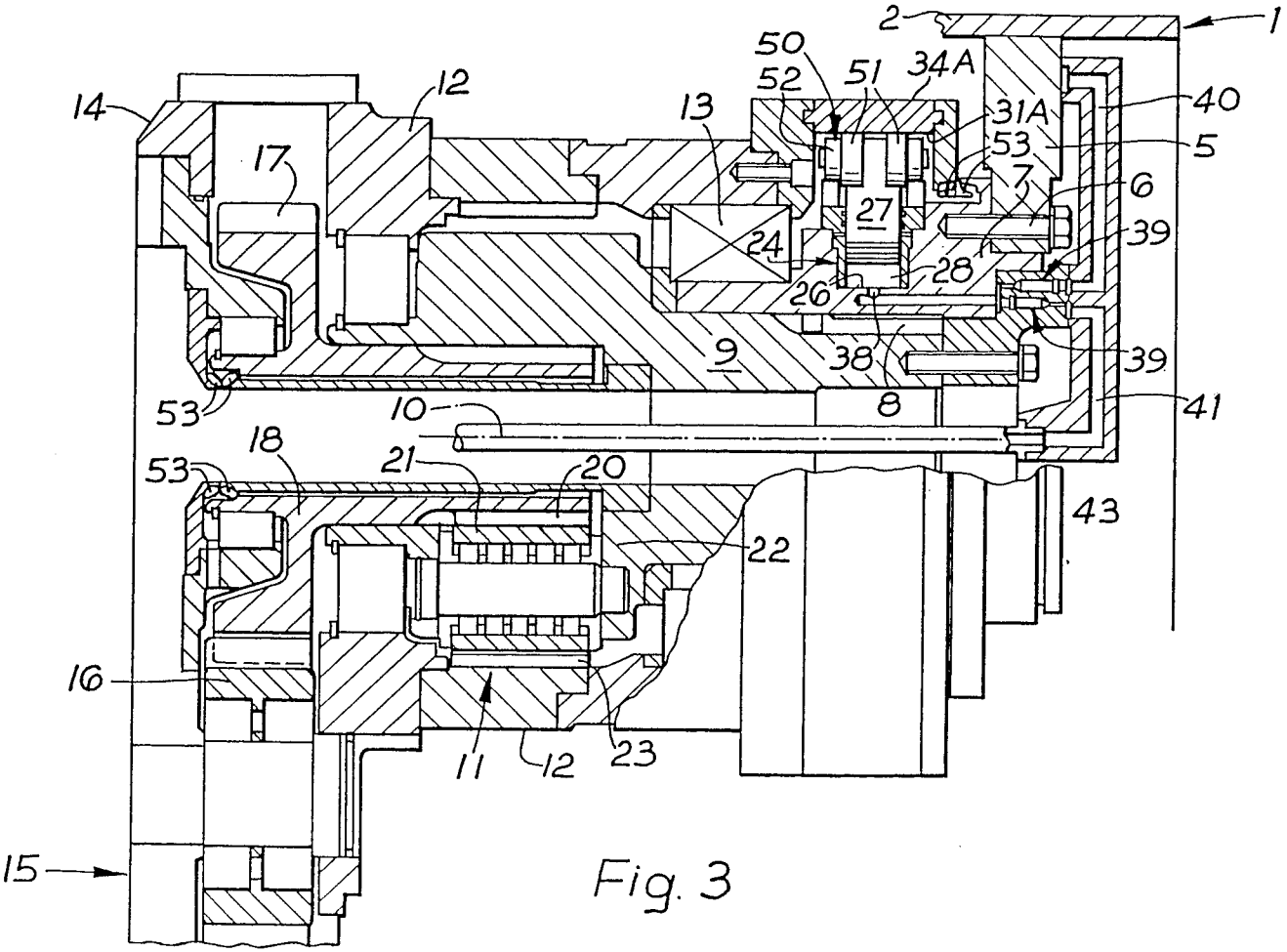

FIG. 3 corresponds to FIG. 1 but shows a second embodiment; and

Figure 4:
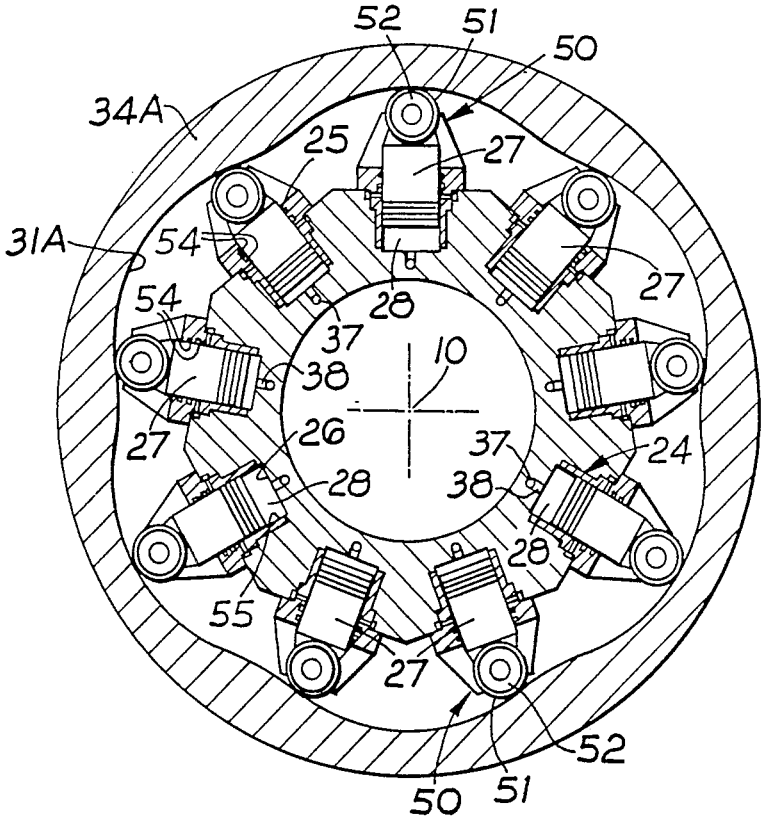

FIG. 4 is a transverse sectional view through the embodiment of FIG. 3.

In both embodiments, like components are accorded like reference numerals.

A rotary, mineral winning, cutting head 1, comprises an outer barrel part 2 around which is welded at least one helical vane 3 carrying, in the well known manner, a plurality of pick boxes (not shown) each to retain releasably a mineral cutter pick (not shown). Around one end of the barrel part 2 is also welded an end plate 4, likewise provided with pick boxes and picks. The barrel part 2 is attached to a first inner collar 5 which is seated on, and secured by bolts 6 to, a second collar 7 drivably mounted by splines 8 on a hollow output drive shaft 9 rotatable about longitudinal axis 10, of a gearbox 11 in accordance with the invention.

The gearbox 11 is of the epicyclic/planetary kind and is partially located within the barrel part 2. The drive shaft 9 is rotatably supported against a gearbox casing 12 by interposed, first and second roller bearings 13, spaced apart along the axis 10. The casing 12 and hence the gearbox 11 is carried at one end 14 of a ranging arm 15 pivotally attached at its other end, in the well known manner, to a shearer type mining machine (not shown). THe arm 15 is hollow and carries a gear train drivably connected to an electric motor (not shown) and terminates in a drive pinion 16 in mesh with a first gear ring 17 of a sun gear 18 which is mounted for rotation about the axis 10 on a double roller bearing 19 carried by the gearbox 11, whilst a second gear ring 20 is in drivable engagement with a plurality of planet wheels 21 carried by a carrier 22 which is constituted by a portion of the drive shaft 9, the plane wheels 21 being in mesh with a stationary annulus 23 carried by the casing 12. It will be seen that conventional oil seals 53 are provided outside each bearing 13 to retain lubricating oil within the gearbox 11.

The carrier 22 is provided with nine radially extending cylinders 24, located in a common diametral plane, and spaced 40° apart around the axis 10. Each cylinder interior is defined by a liner sleeve 55, with an open, outer end 25 and a closed, inner end 26, and each cylinder 24 partially houses a reciprocable piston 27, with a variable volume pressure-generating chamber 28 defined between a radially inner end 29 of the piston 27 and the closed, inner end 26 of its cylinder. It will be observed that fluid seals 54 are provided between the external periphery of the pistons 27 and the cylinder 24, to maintain separation between the fluid (in practice water or a water/soluble oil emulsion) in the pressure generating chambers 28 from the lubricating oil of the gearbox.

Figure 2:
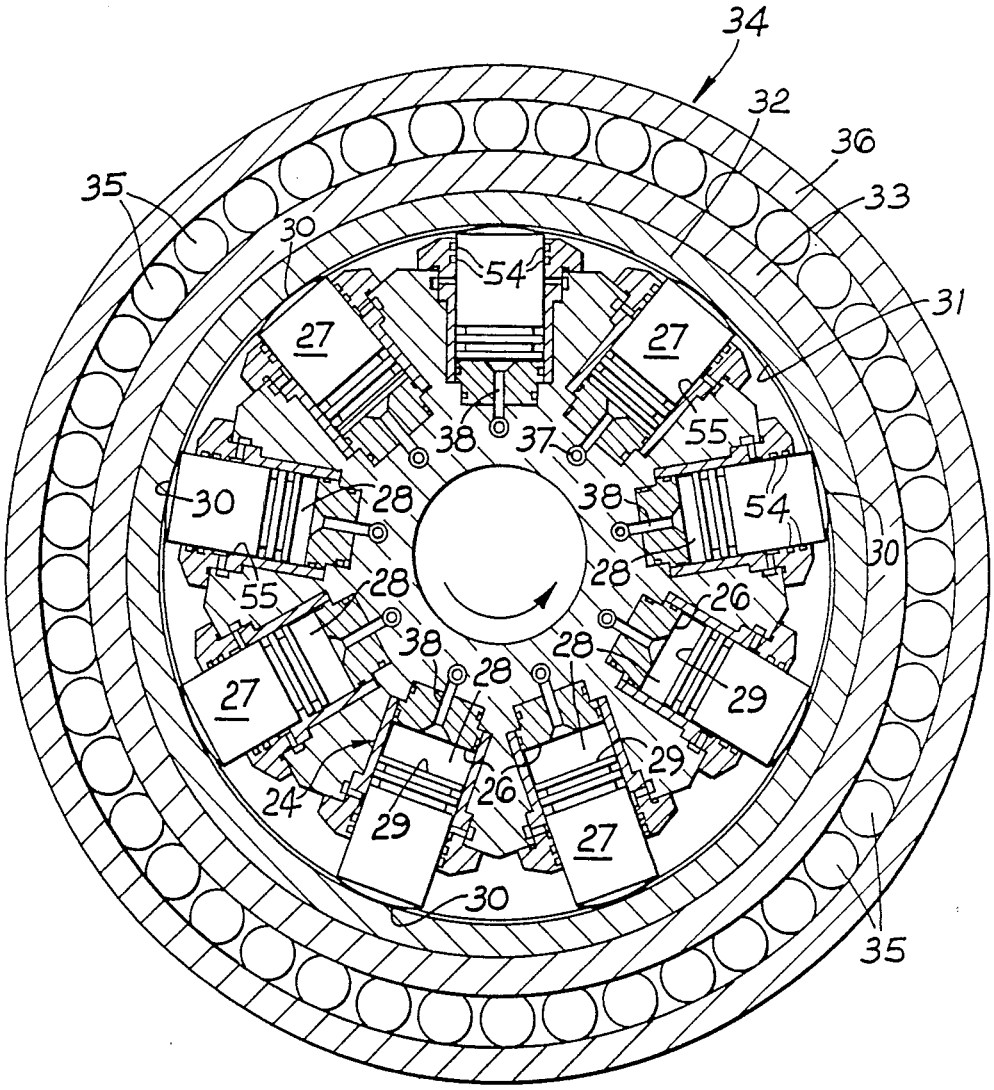
FIG. 2 is a transverse sectional view through a portion of FIG. 1.

In the embodiment of FIGS. 1 and 2, radially outer ends 30 of the pistons 27 are (when the chambers 28 are provided with pressure fluid) in direct engagement with an inner annular face 31 (constituting the inner profile) of a liner ring 32 of an inner race part 33 of a bearing ring 34, with double roller bearings 35 interposed between the inner race part 33 and an outer race part 36, the bearing ring 34 being located eccentrically with respect to the axis 10, so that one revolution of the drive shaft 9 produces one delivery stroke of the or each piston 27.

A fluid transfer port 37 is in fluid flow communication with each pressure-generating chamber 28, each port 37 extending axially along the drive shaft 9. One end of each transfer port 27 terminates at a radial connection port 38 in communication with its assocated pressure-generating chamber 28, while the other end of each transfer port 37 is in fluid flow communication with a valve means 39 to control fluid admission to, and delivery from, the associated pressure-generating chamber 28. A pressure delivery port 30 intersects each transfer port 37 in the vicinity of the valve means 39, which is conveniently a check valve, while supply of low pressure fluid to the valve means 39 is effected by a delivery port 41 having its radially outer end closed by a screw-in plug 56 and connected to an inner one of two concentric tubes 42, 43, of different diameters extending along hollow interior 44 of the drive shaft 9. Drainage passages 57 lead to the hollow interior 44 from radially inner and radially outer end zones of the liner sleeve 55. Each tube 42, 43, is connected to a respective supply conduit 45, 46, in turn connected to a pump (not shown). Each check valve of each valve means 39 takes the form of a spring loaded valve member 46 slidable within a valve body 47.

The hollow interior 44 of the drive shaft 9 is extended by a tube 48 passing through the sun gear 18, to define a hollow shaft, in which is located a water spray nozzle 49 to direct a water spray, and hence an air flow, along the hollow shaft for so-called hollow-shaft ventilation.

In the embodiment of FIGS. 3 and 4, a ring 34A has a lobed inner face 31A, so that multiple reciprocation of pistons 27 is effected during one revolution of the drive shaft 9. Each piston 27 engages the ring 34A indirectly via a follower arrangement 50 comprising a first pair of spaced apart rollers 51 to engage the lobed inner face or profile 31A, and a second pair of spaced apart rollers 52 to engage guide surfaces of a pair of arms projecting from each follower arrangement 50. It will be observed that in the embodiment of FIG. 3 an 4, in contrast to that of FIGS. 1 and 2, the pump arrangement is located remotely from the ranging arm 15. Also in the embodiment of FIGS. 3 and 4 the (low pressure) delivery port 41 is provided with a first valve means 39 and the (high pressure) delivery port 40 is provided with a second valve means 39.

What is claimed is:

1. A gearbox comprising:

a casing;

speed reduction gearing contained in said casing;

at least a portion of a drive shaft also contained in said casing said drive shaft having an axis of rotation;

first and second bearings spaced apart along said axis;

at least one radially extending cylinder having a closed inner end and an open, outer end being provided in said drive shaft;

a reciprocable piston at least partially housed in said cylinder;

a fluid seal between the external periphnery of said piston and said cylinder;

a variable volume, pressure-generating chamber defined between a radially inner end of said piston and a closed inner end of its cylinder;

a ring surrounding said drive shaft with an inner profile provided on said ring;

a radially outer end of said piston being in contact, at least in a pumping mode, with said inner profile, such that upon rotation of said drive shaft, variations in radial distance of said inner profile from said drive shaft axis of rotation cause reciprocation of said piston, and a consequent pumping effect;

at least one fluid transfer port communicating with said pressure-generating chamber;

with said first and second bearings also absorbing loading from said piston and said ring;

valve means to control fluid admission to, and delivery from, each of said pressure-generating chamber; and oil seals at the outsides of said first and second bearings between rotary and non-rotary parts of said gearbox to maintain separation between said fluid within said pressure generating chamber and lubricating oil of said gearbox.

2. A gearbox as claimed in claim 1, of the epicyclic kind, comprising a sun gear rotatable about said drive shaft axis and in drivable engagement with a plurality of planet gears carried by a portion of said drive shaft serving as a carrier, with said planet gears rotatable about axes parallel to said sun gear axis, and in mesh with a stationary annulus.

3. A gearbox as claimed in claim 1, provided with a multiple number of said cylinders and pistons, located in a common diametral plane.

4. A gearbox as claimed in claim 1, wherein said valve means is a check valve, and one valve means per transfer port is employed.

5. A gearbox as defined in claim 1, in combination with a rotary, mineral cutting head, with said first and second bearings also serving to absorb loading imposed upon said cutting head during cutting.

6. A gearbox as claimed in claim 1, wherein said inner profile of said ring is circular, with said ring located eccentrically with respect to said drive shaft axis of rotation.

7. A gearbox as claimed in claim 1, wherein said ring is in the form of a bearing ring, with said inner profile provided by an inner annular face of an inner race part which is separated from an outer race part by a plurality of rollers, and said outer race part is located stationarily with respect to said drive shaft.

8. A gearbox as claimed in claim 1, wherein said ring is located concentrically with respect to said drive shaft axis of rotation, with said inner profile lobed, to constitute a cam track, said ring being located stationarily with respect to said drive shaft.

9. A gearbox as claimed in claim 8, wherein an outer end of said piston(s) is provided with a roller follower arrangement, for indirect engagement with said profile.

10. A gearbox as claimed in claim 1, wherein said fluid transfer port(s) serves for both the conveying of low pressure fluid to its associated pressure-generating chamber, and the delivery of high pressure fluid from its associated pressure-generating chamber.

11. A gearbox as claimed in claim 10, wherein said fluid transfer port(s) extends axially along said drive shaft and terminates at one end at a radial connection port in communication with its associated pressure-generating chamber.

* * * * *